US005298292A

United States Patent [19]

Dilko et al.

[11] Patent Number: 5,298,292

[45] Date of Patent: Mar. 29, 1994

[54] METHOD FOR APPLYING A COATING SOLUTION

[75] Inventors: John T. Dilko; Robert S. Foltz, both of Rochester; Gene O'Dell, Williamson; David Rich, Brockport; Richard J. Manzolati, Rochester; John J. Darcy, Webster, all of N.Y.

[73] Assignee: Xerox Corporation, Stamford, Conn.

[21] Appl. No.: 891,091

[22] Filed: Jun. 1, 1992

[51] Int. Cl.[5] ..... B05D 3/02

[52] U.S. Cl. ..... 427/543; 427/58; 427/348; 427/372.2; 427/443.2; 427/544; 427/591

[58] Field of Search ..... 427/543, 591, 348, 372.2, 427/443.2, 58, 544

[56] References Cited

U.S. PATENT DOCUMENTS

| | | | |
|---|---|---|---|
| 896,111 | 8/1908 | Howard | 55/278 |
| 4,069,356 | 1/1978 | Fischer | 427/76 |
| 4,456,632 | 6/1984 | Amberkar | 427/124 |
| 4,504,291 | 3/1985 | Haddad et al. | 55/319 |
| 4,543,314 | 9/1985 | Maxwell | 430/134 |
| 4,694,586 | 9/1987 | Reznik | 427/543 |
| 4,719,129 | 1/1988 | Caudill | 427/348 |
| 4,855,203 | 8/1989 | Badesha et al. | 430/59 |
| 4,943,447 | 7/1990 | Nelson et al. | 427/55 |
| 4,975,352 | 12/1990 | Anayama et al. | 430/135 |
| 5,156,683 | 10/1992 | Ross | 427/543 |

FOREIGN PATENT DOCUMENTS 0315179 10/1989 European Pat. Off. .

OTHER PUBLICATIONS

Kirk-Othmer, Encyclopedia of Chemica Technology; 3rd Ed.; Supplement Volume, J. Willey & Sons, 1984, pp. 846–873.

Perry's Chemical Engineer's Handbook 5th Ed; McGraw-Hill Book Company; pp. 20–78; 20–80 to 20–82; 20–84; 20–86 to 20–89; 20–91 to 20–95; 20–98 to 20–103.

*Primary Examiner*—Bernard Pianalto
*Attorney, Agent, or Firm*—Oliff & Berridge

[57] ABSTRACT

A method for applying a coating solution onto a substrate to form a coated portion thereon includes a dipping device for dipping and removing the substrate into and from the coating solution; and a heating device for inductively heating the substrate while the dipping device removes the substrate from the coating solution to uniformly dry an inner surface of the coated portion, the inner surface being adjacent to the substrate. The method advantageously may include a drying device for blowing hot gases onto the coated portion of the substrate while the dipping device removes the substrate from the coating solution. The drying device for blowing hot gases onto the coated portion of the substrate includes a plurality of slits arranged so that a plurality of hot gas streams flowing through corresponding ones of the plurality of slits impinge and exert a gas pressure on the coated portion, the plurality of slits being arranged so that a collective gas pressure from all hot gas streams is uniformly applied across the coated portion along a transverse direction so that the coated portion is squeezed to a uniform thickness as the dipping device removes the substrate.

6 Claims, 4 Drawing Sheets

METHOD FOR APPLYING A COATING SOLUTION

BACKGROUND OF THE INVENTION

1. Field of the Invention

The present invention relates to a method and apparatus for manufacturing drum and flexible belt charge receptors for photocopiers. More particularly, the invention relates to an efficient method and a modular thermal circumference dryer for processing cylindrical or belt-like substrates to apply a coating material to the substrate.

2. Description of Related Art

A photoreceptor is a cylindrical or belt-like substrate used in a xerographic apparatus. The photoreceptor substrate is coated with one or more layers of a photoconductive material, i.e., a material whose electrical conductivity changes upon illumination. In xerographic use, an electrical potential is applied across the photoconductive layer and then exposed to light from an image. The electrical potential of the photoconductive layer decays at the portions irradiated by the light from the image, leaving a distribution of electrostatic charge corresponding to the dark areas of the projected image. The electrostatic latent image is made visible by development with a suitable powder. Better control of the coating quality yields better imaging performance.

One method of coating substrates is to dip the substrate in a bath of the coating material. This method is disadvantageous because it usually results in a non-uniform coating. In particular, when the substrate is oriented vertically and dipped into a bath, the coating thickness tends to "thin" or decrease at the top of the substrate and "slump" or increase at the base of the substrate due to gravity induced flow of the coating material as the substrate is lifted from the bath. Thickness variations also occur even when the photoreceptor is oriented horizontally and dipped into the bath due to the formation of a meniscus as the substrate is removed from the bath. This variation in coating thickness causes variations in the performance of the photoreceptor.

In another method, an air assisted automatic spray gun uses high velocity air to atomize the coating formulation which is sprayed onto a substrate. Due to high mass transfer rates intrinsic to the use of atomizing air, this method entails considerable evaporative loss of solvent from the spray droplets and requires the use of slow evaporating solvents to prevent excessive solvent loss before the droplets arrive at the substrate. It is difficult to use this method in a sealed environment, and thus difficult to control the solvent humidity surrounding the substrates prior to, during, or after the coating process. In addition, the air atomized spray method creates a considerable amount of overspray which results in higher material usage.

U.S. Pat. No. 4,456,632 to Amberkar discloses a method and apparatus for fabricating electrosensitive paper with a white finish comprising a base layer of paper, a solvent-based resin coating, and a thin layer of aluminum, optionally including a white overcoat. The patent states that a mixture of solvents, having different evaporation rates, are employed to provide a white appearance and that the mixture may include a volatile true solvent as well as a less volatile diluent. The patent discloses that after the application of the resin coating to the paper base, the solvents are evaporated by a three-stage drying process where the first stage involves an elevated temperature with turbulent air flow.

U.S. Pat. No. 4,975,352 to Anayama et al discloses an electrophotographic photosensitive member comprising a conductive support, and having thereon a charge generation layer formed by coating, and then followed by drying, and further comprising a charge transport layer formed by coating, and then followed by drying. The patent states that the drying process is carried out by heating a freshly dipped cylinder at 80° C. for 10 minutes.

U.S. Pat. No. 4,543,314 to Maxwell discloses a process for preparation of an electrostatographic photosensitive device comprising: (1) combining a sodium additive with trigonal selenium particles, an organic resin binder and a solvent for the binder to form a milling mixture, (2) milling the mixture to form a uniform dispersion, (3) applying the dispersion to a substrate, and (4) drying the layer. The patent states that in the prior art the trigonal selenium layer can be dried at 60° C. in a forced air oven for 18 hours, and discloses that conventional drying methods can be employed such as oven drying, radiant heat drying, forced air drying and the like.

U.S. Pat. No. 4,069,356 to Fischer discloses a method for rapidly forming photoconductive layers for integrated circuits wherein powders of component materials are mixed with a copper halide powder and formed into pellets. The pellets are used as an evaporant source for vacuum deposition of a photoconductive layer onto a prepared substrate. The patent states that the photoconductive layer and substrate are then baked in an oxygen- rich atmosphere at a temperature between 300° and 550° C.

U.S. Pat. No. 4,855,203 to Badesha et al discloses a layered photo responsive imaging member comprised of: (1) a supporting substrate, (2) an amorphous photoconductive layer, and (3) a hole transporting layer dispersed in a resinous binder. The patent states that a solution is deposited on the supporting substrate and subsequently heated to dry the layer to the member.

U.S. Pat. No. 4,943,447 to Nelson et al discloses a process for heat treating a coating applied to an automobile body which is carried out with an apparatus comprising radiant heating elements for generating radiant heat in a predetermined path and convection heating elements for generating a flow of heated air.

The related art described above does not disclose a manufacturing process or apparatus for practicing the manufacturing process with low cost high quality efficient drying of dipped photoreceptors.

SUMMARY OF THE INVENTION

It is thus an object of the invention to obviate the foregoing drawbacks of the prior art by providing a more efficient apparatus and process for fabricating rigid cylindrical or flexible belt photoreceptors.

Another object of the invention is to provide an apparatus and method which permits processing of a plurality of substrates in compatible coating and drying operations with relatively reduced process cycle times.

It is another object of the invention to provide an apparatus and method which obtains high quality coatings of uniform thickness and without surface defects.

Another object of the invention is to provide an apparatus and method for coating substrates which is modular and occupies a relatively small area and consumes relatively small amounts of energy per unit of production.

It is another object of the invention to provide an apparatus and method for coating substrates which is relatively quickly adaptable to different coating material formulations and substrates.

These and other objects are achieved with an apparatus for applying a coating solution onto a substrate to form a coated portion thereon including a dipping device for dipping and removing the substrate into and from the coating solution; and a heating device for inductively heating the substrate while the dipping device removes the substrate from the coating solution to uniformly dry an inner surface of the coated portion, the inner surface being adjacent to the substrate. This apparatus may advantageously include a drying device for blowing hot gases onto the coated portion of the substrate while the dipping device removes the substrate from the coating solution.

These and other objects are achieved with an apparatus for applying a coating solution onto a substrate to form a coated portion thereon including a dipping device for dipping and removing the substrate into and from the coating solution by moving the substrate in a dipping and removing direction; and a drying device for blowing hot gases onto the coated portion of the substrate through a plurality of slits arranged so that a plurality of hot gas streams flowing through corresponding ones of the plurality of slits impinge and exert a gas pressure on the coated portion, the plurality of slits being arranged so that a collective gas pressure from all hot gas streams is uniformly applied across the coated portion along a transverse direction transverse to the removing direction so that the coated portion is squeezed to a uniform thickness as the dipping device removes the substrate from the coating solution.

These and other objects are achieved with a method for applying a coating solution to a substrate to form a coated portion thereon including the steps of dipping the substrate into the coating solution; removing the substrate from the coating solution; and inductively heating the substrate while the substrate is being removed from the coating solution to uniformly dry an inner surface of the coated portion, the inner surface being adjacent to the substrate. This method may advantageously include the step of blowing hot gases onto the coated portion of the substrate while the substrate is being removed from the coating solution.

These and other objects are achieved with a method for applying a coating solution onto a substrate to form a coating portion thereon including the steps of dipping the substrate into the coating solution; removing the substrate from the coating solution in a removing direction; and blowing hot gases onto the coated portion to squeeze the coated portion to a uniform thickness while the substrate is being removed, the hot gases forming a collective pressure being uniformly applied across the coated portion along a transverse direction transverse to the removing direction.

BRIEF DESCRIPTION OF THE DRAWINGS

The invention will be described in detail herein with reference to the following figures in which like reference numerals denote like elements and wherein.

DETAILED DESCRIPTION OF PREFERRED EMBODIMENTS

The invention will be described in relation to the fabrication of cylindrical and belt-like substrates, and particularly rigid cylindrical and flexible belt photoreceptor substrates for photocopiers. The invention, however, is applicable to other coated substrates and/or coating processes.

Figure 1:
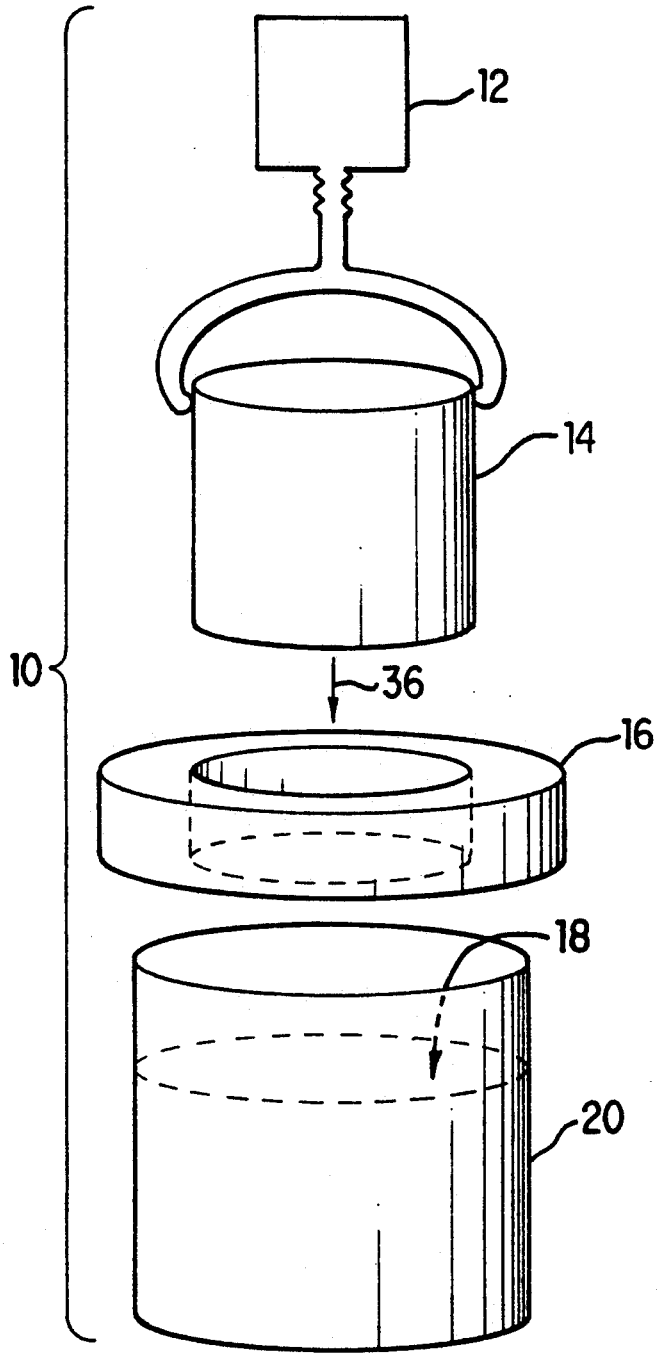
FIG. 1 shows a perspective view of a manufacturing apparatus of the present invention.

In FIG. 1, manufacturing apparatus 10 includes dipping device 12, thermal circumference dryer 16 and tank 20 for holding coating solution 18. The article to be manufactured is substrate 14 moved by dipping device 12 in a dipping direction 36 through thermal circumferential dryer 16 so as to be dipped in coating solution 18. After being dipped for a prescribed time according to the nature of the coating solution 18 and the desired properties of a coated portion 31 (FIG. 4A) to be coated on substrate 14, dipping device 12 removes substrate 14 from coating solution 18 through thermal circumferential dryer 16 in a removing direction opposite to dipping direction 36.

Figure 2:
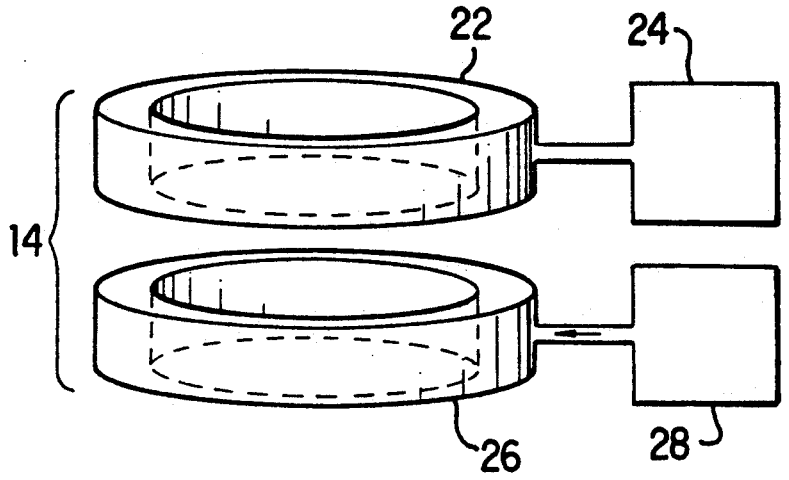
FIG. 2 shows a perspective view of a thermal circumference dryer of the present invention.

In FIG. 2, thermal circumference dryer 16 includes inductive heater 22 and peripheral drying ring 26. Inductive heater 22 is driven by inductive heater driver source 24, and peripheral drying ring 26 is supplied with hot gases from hot gas source 28. For example, hot air may be supplied.

It will be appreciated that peripheral drying ring 26 may advantageously include heaters so that hot gas source 28 may supply relatively cold gas which is thereafter heated within peripheral drying ring 26. Further, it will be appreciated that thermal circumference dryer 10 may be formed of an integrally combined inductive heater 22 and peripheral drying ring 26, integrated as a single unit having two functions.

Figure 3:
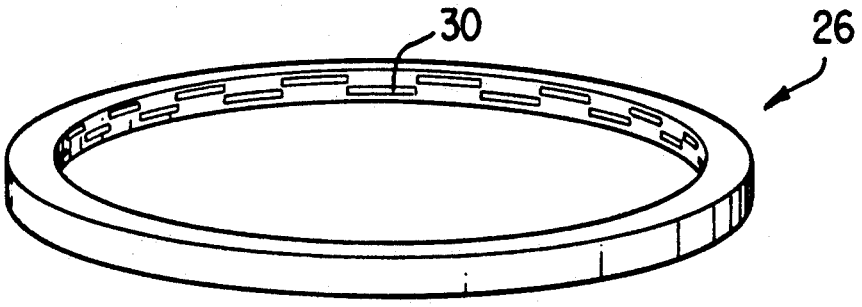
FIG. 3 shows a perspective view of a peripheral drying ring of the present invention.

In FIG. 3, peripheral drying ring 26 is shown to have a plurality of slits such as slit 30. Peripheral drying ring 26 is formed from a hollow cross section tube like structure arranged annularly so that hot gases supplied from hot gas source 28 flows through hollow portions within peripheral drying ring 26 and passes through the plurality of slits such as slit 30. It will be appreciated that the slits are disposed on an inner surface of the peripheral drying ring so as to confront a substrate passing through a center of peripheral drying ring 26 as it is being dipped and removed by the dipping device 12.

Figure 4A:
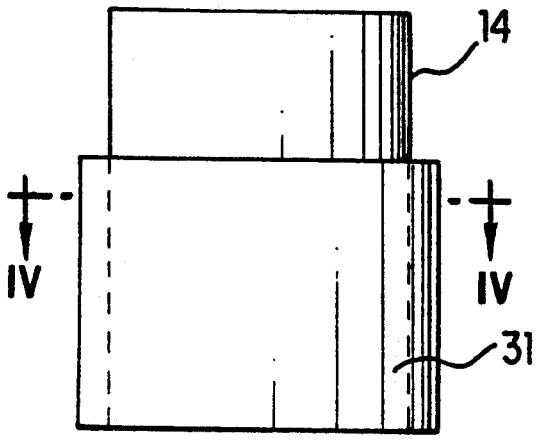
FIG. 4A shows a side view of a substrate having a coated portion thereon.
Figure 4B:
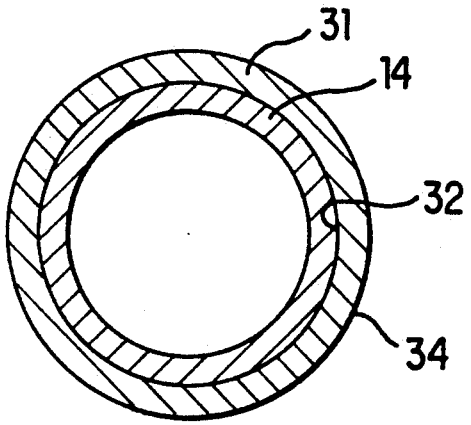
FIG. 4B shows a sectional view along section line IV—IV of FIG. 4A.

In FIG. 4A, substrate 14 is shown after having being dipped so as to have formed thereon coated portion 31. In FIG. 4B, a section view along section lines IV—IV includes substrate 14, coated portion 31, an inner surface 32 of coated portion 31 adjacent to substrate 14 and an outer surface 34 of coated portion 3 1.

Figure 5:
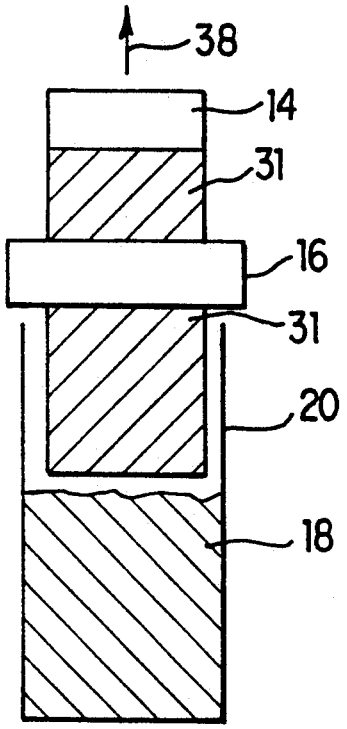
FIG. 5 shows a side view of a substrate being coated according to the present invention.

In operation, dipping device 12 causes substrate 14 to pass through a center of thermal circumference dryer 16 into coating solution 18 so that a coated portion 31 is formed thereon. Subsequently, as shown in FIG. 5, dipping device 12 removes substrate 14 from coating solution 18 by moving substrate 14 in the removing direction 38 while passing through a center of thermal circumference dryer 16. At this point, two significant drying effects can be appreciated.

First, inductive heater 22 induces heat within substrate 14. The induction nature of inductive heater 22 enables energy to transfer through coated portion 31 and into substrate 14 where it is dissipated as heat, thus permitting inner surface 32 of coated portion 31 to be heated preferentially over outer surface 34 of coated portion 31. It will be appreciated that hot air passing through the plurality of slits such as slit 30 impinges on outer surface 34 of coated portion 31 so as to heat outer surface 34 preferentially over inner surface 32. Therefore, by proper control of induction heater drive source 24 and hot gas source 28, both the inner surface 32 and outer surface 34 of coated portion 31 may be heated to evenly heat and uniformly dry coated portion 31. It will be appreciated that inner surface 32 may be advantageously heated to a greater temperature than outer surface 34, or outer surface 34 may be advantageously heated to a greater temperature than inner surface 32 as any particular coating solution may require. Further, the thermal circumference dryer 16 may be formed so as to advantageously dispose the inductive heater 22 closer to the coating solution 18 than the peripheral drying ring 26, or dispose the peripheral drying ring 26 closer to the coating solution 18 than the inductive heater 22, as the nature of the coating solution may require.

A second important effect of the peripheral drying ring 26 of the present invention is that hot gases passing through the plurality of slits such as slit 30 impinge on the coated portion 31 so as to exert a gas pressure on the coated portion. The gas pressure from all of the hot gas streams passing through the plurality of slits collect to form a collective pressure being uniformly applied across coated portion 31 along a transverse direction transverse to removing direction 38. This collective pressure squeezes the coating solution 18 which has adhered to substrate 14 as coated portion 31 so that as substrate 14 is removed in the removing direction 38 the squeezing action of the collective gas pressure squeezes the coated portion 31 to a uniform thickness free of defects. It will be appreciated that the slits may be replaced by any appropriately shaped aperture. It will be further appreciated that a thermal circumference dryer may include at least one inductive heater 22 and at least one peripheral dryer ring 26 arranged so that as substrate 14 having coated portion 31 thereon is removed in the removing direction, the coated portion 31 first encounters a first peripheral drying ring supplied with gas from a relatively cold gas source under high pressure so as to squeeze the coated portion 31 to a uniform thickness, and then through an inductive heater 22, and then through a second peripheral drying ring 26 supplied with gas from a relatively hot gas source.

Figure 6:
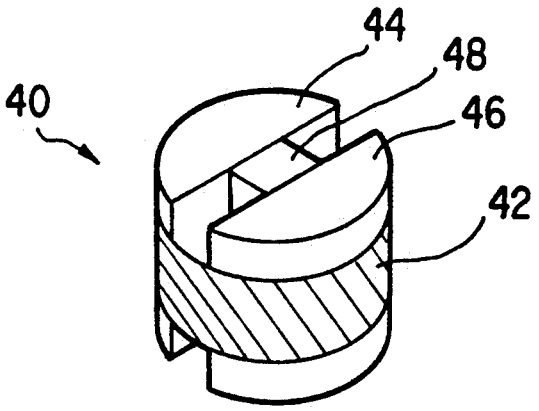
FIG. 6 shows a belt frame for processing a flexible belt according to the present invention.

In FIG. 6, belt frame 40 is shown to include first part 44, second part 46 and an expansion device 48 disposed between the first and second parts 44, 46. Flexible belt 42, such as a photoreceptor belt, is disposed around both first and second parts of the frame and held snugly in place by expanding the expansion device 48. Thus, belt frame 40 having flexible belt 42 disposed thereareound may be dipped into coating solution 18 by dipping device 12 according to the present invention. Flexible belt 42 and belt frame 40 form a rigid structure to withstand the collective pressure applied to the coating portion 31 by the pressure of the individual hot gas streams flowing through each of the plurality of slits.

The foregoing specification describes preferred embodiments of a novel method and apparatus for processing rigid drum and flexible belt charge receptors using a thermal circumference dryer. The invention has been described with reference to the preferred embodiments thereof which are intended to be illustrative rather than limiting. Various changes in modifications may be made without departing from the spirit and scope of the invention as defined in the following claims.

What is claimed is:

1. A method for applying a coating solution onto a substrate to form a coated portion thereon, the method comprising the steps of:

dipping the substrate into the coating solution, the substrate being circularly disposed;

removing the substrate from the coating solution;

inductively heating the substrate while the substrate is being removed from the coating solution to uniformly dry an inner surface of the coated portion, the inner surface being adjacent to the substrate; and blowing hot gases evenly onto a periphery of the coated portion to uniformly dry an outer surface of the coated portion and squeeze the coated portion to a uniform thickness while the substrate is being removed from the coating solution.

2. The method of claim 1, wherein the step of removing includes a step of removing the substrate by moving the substrate vertically from the coating solution.

3. The method of claim 1, wherein the step of blowing hot gasses includes a step of passing a plurality of hot gas streams through a corresponding plurality of slits to uniformly dry an outer surface of the coated portion while the inner surface of the coated portion is being dried by the step of inductively heating.

4. The method of claim 3, wherein the step of passing a plurality of hot gas streams includes a step of squeezing the coated portion to a uniform thickness while the substrate is being removed, the coated portion being squeezed by uniformly applying the plurality of gas streams to the periphery of the coated portion so that a collective gas pressure is formed from all hot gas streams and uniformly applied to the coated portion.

5. The method of claim 1, arranged so that the step of inductively heating commences before the step of blowing.

6. The method of claim 1 arranged so that the step of blowing commences before the step of inductively heating.

* * * * *